US008365673B2

(12) United States Patent
Plyler et al.

(10) Patent No.: US 8,365,673 B2
(45) Date of Patent: Feb. 5, 2013

(54) SYSTEM AND METHOD FOR RAILROAD TRACK TIE PLATE COLLECTION FROM A RAIL BED

(75) Inventors: Mark Plyler, Notasulga, AL (US); Andy Loftis, Pike Road, AL (US); Dennis Grantham, Elmore, AL (US); Gary Gibson, Montgomery, AL (US)

(73) Assignee: Progress Rail Services Corp, Albertville, AL (US)

( * ) Notice: Subject to any disclaimer, the term of this patent is extended or adjusted under 35 U.S.C. 154(b) by 241 days.

(21) Appl. No.: 12/642,202

(22) Filed: Dec. 18, 2009

(65) Prior Publication Data

US 2011/0146526 A1 Jun. 23, 2011

(51) Int. Cl.
*E01B 3/00* (2006.01)
*E01B 27/00* (2006.01)

(52) U.S. Cl. ..... 104/16; 171/16

(58) Field of Classification Search ..... 104/2, 4, 104/5, 7.1, 9, 16; 37/104; 171/16
See application file for complete search history.

(56) References Cited

U.S. PATENT DOCUMENTS

| | | | | |
|---|---|---|---|---|
| 3,768,739 | A * | 10/1973 | George | 280/47.371 |
| 3,943,858 | A | 3/1976 | Dieringer et al. | |
| 4,225,429 | A * | 9/1980 | Holley | 209/215 |
| 4,241,663 | A | 12/1980 | Lund et al. | |
| 4,280,613 | A | 7/1981 | Stewart | |
| 4,691,639 | A * | 9/1987 | Holley | 104/16 |
| 4,722,283 | A * | 2/1988 | Holley | 104/279 |
| 4,727,989 | A | 3/1988 | Cotic et al. | |
| 4,819,784 | A | 4/1989 | Sticht | |
| 4,907,686 | A | 3/1990 | Cotic | |
| 4,909,375 | A | 3/1990 | Cotic et al. | |
| 4,940,001 | A | 7/1990 | Holley | |
| 4,942,822 | A | 7/1990 | Cotic | |
| 4,974,518 | A | 12/1990 | Cotic et al. | |
| 5,038,914 | A | 8/1991 | Cotic et al. | |
| 5,063,856 | A | 11/1991 | Theurer et al. | |
| 5,067,412 | A | 11/1991 | Theurer et al. | |
| 5,074,219 | A | 12/1991 | Theurer et al. | |
| 5,331,899 | A * | 7/1994 | Holley | 104/16 |
| 5,655,455 | A | 8/1997 | Smith | |
| 5,961,055 | A | 10/1999 | Lehtinen | |
| 6,167,607 | B1 | 1/2001 | Pryor | |
| 6,595,140 | B1 | 7/2003 | Madison et al. | |
| 6,807,909 | B1 * | 10/2004 | Coots | 104/16 |
| 6,974,097 | B2 | 12/2005 | Simon et al. | |
| 7,097,029 | B2 | 8/2006 | Halang | |
| 7,243,777 | B2 | 7/2007 | Reznik et al. | |
| 7,827,916 | B2 | 11/2010 | Coots, Jr. | |
| 7,926,426 | B2 * | 4/2011 | Sperling | 104/279 |
| 2009/0188406 | A1 | 7/2009 | Sperling | |

FOREIGN PATENT DOCUMENTS

| | | |
|---|---|---|
| WO | 2008154986 | 12/2008 |

* cited by examiner

*Primary Examiner* — Robert McCarry, Jr.

(57) ABSTRACT

A machine for collecting tie plates strewn along a rail bed includes a frame adapted for travel along a railroad in a forward direction. A pickup drum having magnetic properties is rotatably supported by the frame and extends over a bed portion of the railroad. A top drum is mounted at a location that is higher and forward of the pickup drum and rotates parallel to the pickup drum. An endless conveyor circulates around the pickup and top drums, and a separation drum is disposed between the pickup drum and the top drum along an ascending portion of the endless conveyor. The separation drum includes a magnetized rim that can lift ferrous objects but not tie plates from the endless conveyor.

20 Claims, 3 Drawing Sheets

SYSTEM AND METHOD FOR RAILROAD TRACK TIE PLATE COLLECTION FROM A RAIL BED

TECHNICAL FIELD

This patent disclosure relates generally to railroad track construction, maintenance, and service equipment and, more particularly, equipment for retrieving, collecting, and sorting tie plates from a rail bed.

BACKGROUND

Equipment for mechanically retrieving tie plates strewn along rail beds have been proposed in the past. One example of a proposed tie plate collection machine can be found in U.S. Pat. No. 5,655,455 ("the '455 patent"), which is incorporated herein in its entirety by reference. The tie plate collection device disclosed in the '455 patent includes a rotating magnetic wheel having a plurality of flanges that extend around its rim. A collection slide of the machine is mounted next to the magnetic wheel. As the magnetic wheel rotates, tie plates attach to the flanges of the wheel and are carried along the wheel until they are "scraped" off the wheel by the collection slide.

In the device disclosed in the '455 patent, tie plates are retrieved from the rail bed and stored for later use. The device, however, is unable to sort the collected tie plates or separate the collected tie plates from other metallic or ferrous debris that may be collected from the rail bed along with the tie plates. Separation, sorting, and orientation of the tie plates is accomplished manually by one or more operators of the machine. However, such a manual solution is time consuming, susceptible to operator error, and increases labor costs for operation of the machine.

SUMMARY

In one aspect, the disclosure describes a machine for collecting tie plates strewn along a rail bed. The machine includes a frame adapted for travel along a railroad in a forward direction. A pickup drum having magnetic properties is rotatably supported by the frame and extends over a portion of the rail bed. A top drum is mounted at a location that is higher and forward of the pickup drum and rotates parallel to the pickup drum. An endless conveyor circulates around the pickup and top drums, and a separation drum is disposed between the pickup drum and the top drum along an ascending portion of the endless conveyor. The separation drum includes a magnetized rim that can lift ferrous objects, but not tie plates, from the endless conveyor, thus separating debris from the tie plates collected.

In another aspect, the disclosure describes a conveyor system for sorting tie plates, such as those used in railroads, from other ferrous objects collected from a rail bed. The conveyor system includes a pickup drum rotatably supported by a frame and extending over the rail bed. The pickup drum may have magnetic properties to attract tie plates and other ferrous objects strewn along the rail bed. A top drum is rotatably supported by the frame and disposed at a location that is higher and offset from the pickup drum. The top drum is arranged to rotate about an axis that is parallel to an axis of rotation of the pickup drum such that an endless conveyor can circulate around the pickup and top drums. A separation drum is disposed between the pickup drum and the top drum along an ascending portion of the endless conveyor. The separation drum includes a magnetized rim that attracts ferrous objects other than tie plates.

In yet another aspect, the disclosure describes a method for sorting tie plates collected from a rail bed from other ferrous objects collected from the rail bed. The method includes rotatably supporting a pickup drum from a frame and extending the pickup drum over the rail bed. Tie plates and other ferrous objects may be attracted to the pickup drum by magnetic force. A top drum rotatably supported from the frame is positioned at a location that is higher and offset relative to the pickup drum. The top drum is arranged to rotate about an axis that is parallel to an axis of rotation of the pickup drum such that an endless conveyor can be circulated around the pickup and top drums. A separation drum is rotatably supported between the pickup drum and the top drum along an ascending portion of the endless conveyor. The separation drum includes a magnetized rim that removes ferrous objects that are lighter than tie plates from the endless conveyor, by attracting the other ferrous objects to the separation drum by magnetic forces. A separation slide having a wedge disposed adjacent the magnetized rim of the separation drum is provided to remove the ferrous objects from the separation drum.

DETAILED DESCRIPTION

This disclosure relates to machines and equipment for use during installation, replacement, service, and/or maintenance of railroad tracks. Routine maintenance of a railroad track includes replacement of certain railroad cross ties. Railroad tie replacement can include various operations, such as removing spikes that secure the tie plates to the cross ties, removing the tie plates, replacing the cross ties beneath the track, and retrieving and reinstalling the tie plates, which are typically strewn on the rail bed beside the track. Machines and devices for removing and reinstalling spikes and cross ties, as well as machines for collecting tie plates strewn on the rail bed along the track have been proposed in the past, but the inventors herein know of no commercially successful machines that are known to be currently on the market.

The present disclosure further relates to a system and method for retrieving tie plates and separating them from other metallic or ferrous objects, such as rail spikes, which are strewn along a rail bed after removal of tie plates, rail sections, or rail ties. The disclosed system and method includes a continuous belt capable of collecting metallic objects from the rail bed by magnetic force. Advantageously, the disclosed system and method is capable of segregating tie plates from other metallic objects collected. This ability to segregate the collected objects presents a considerable improvement to systems proposed in the past.

Figure 1:
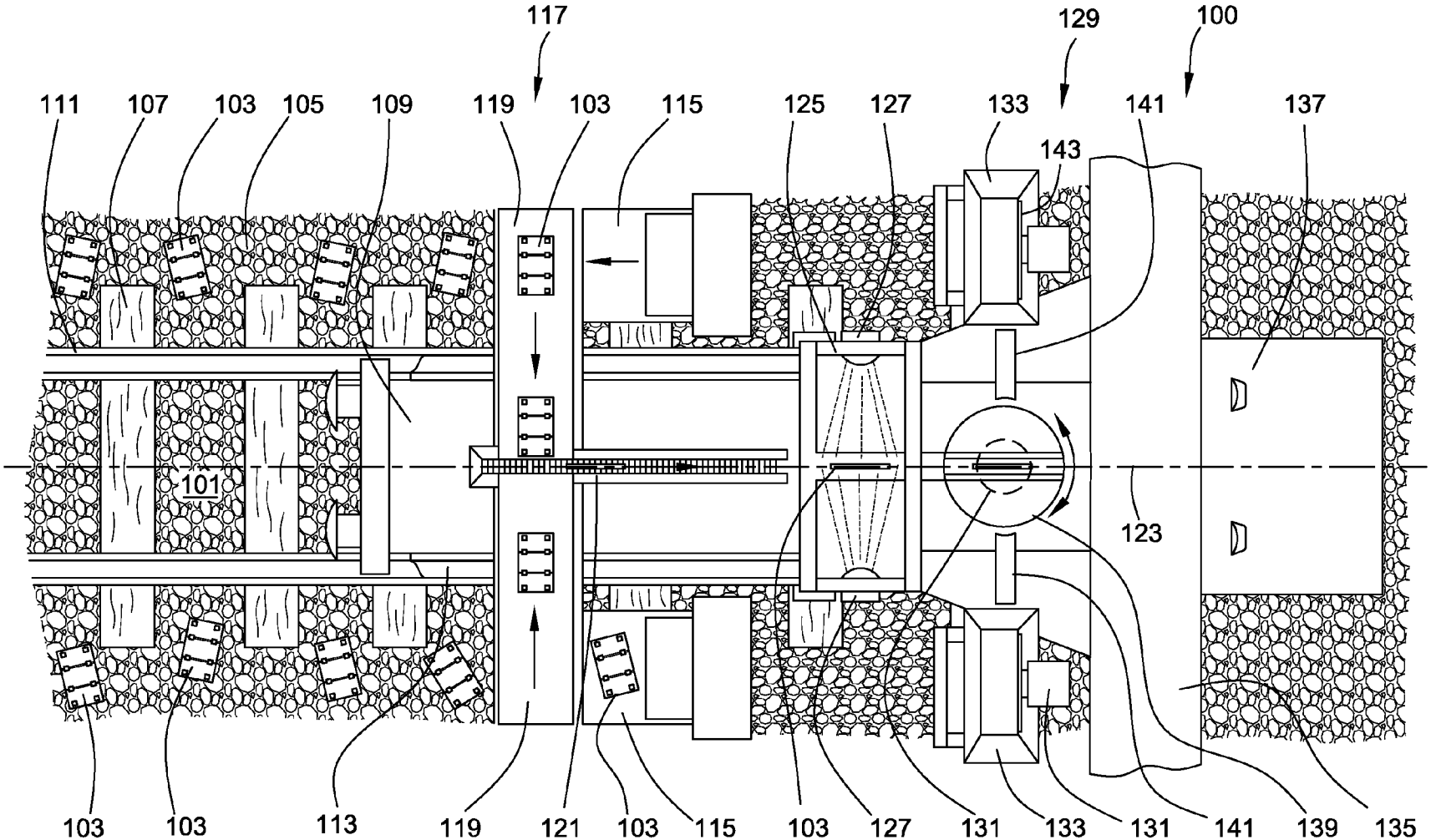
FIG. 1 is an outline view from the top of a tie plate collector machine in accordance with the disclosure.

A partial view of a tie plate placing machine 100 from a top perspective during operation along a railroad track 101 is shown in FIG. 1. The tie plate placing machine 100 is capable of collecting tie plates 103 that are strewn in the rail bed 105 along the railroad track 101 after they have been removed and one or more rail ties 107 have been replaced. In the illustrated embodiment, the machine 100 includes a frame 109 that travels along the rails 111 on wheels 113.

In the illustrated embodiment, a collector 115 disposed on either side of the machine 100 collects tie plates 103 from the rail bed 105 as the machine 100 moves along the rails 111. The collected tie plates 103 are provided to a conveyor system 117, which in the illustrated embodiment includes two transverse conveyors 119 that carry tie plates 103 from the collectors 115 toward a longitudinal conveyor 121. The direction of motion of tie plates 103 along the conveyor system 117 is denoted by arrows, although it can be appreciated that other types of conveyors may be used. Alternatively, other devices or systems may be employed for the transfer of tie plates 103 from one location of the machine 100 to another. In the embodiment illustrated in FIG. 1, each transverse conveyor 119 includes a rotating belt that carries tie plates 103 lying flat on the belt. The tie plates 103 are carried toward the centerline 123 of the machine 100, where tie plates 103 from both transverse conveyors 119 are dropped onto the longitudinal conveyor 121.

The longitudinal conveyor 121 includes a moving chain or another member moving within a channel in an endless fashion. Tie plates 103 deposited onto the longitudinal conveyor 121 are dropped into the channel such that they travel along the longitudinal conveyor on their edge, as shown in FIG. 1. An optional ledge (not shown) may be arranged at a height above the longitudinal conveyor 121 that is sufficient to permit passage of a tie plate 103 standing on its long edge to pass thereunder, and which contacts those tie plates 103 standing on their short edges, causing them to tip onto one of their long edges while on the longitudinal conveyor 121 as they pass under the ledge and to continue travelling along the longitudinal conveyor 121.

In the illustrated embodiment, tie plates 103 are delivered to a sensing portion 125 disposed around at least a portion of the conveyor system 117 as they travel along the longitudinal conveyor 121. In alternate embodiments, the tie plates 103 may pass through the sensing portion 125 by different means, for example, by sliding along an inclined surface.

The sensing portion 125 may include one or more sensors 127 that scan each tie plate 103 passing therethrough to determine the location, orientation, and/or size of its physical features as well as to determine its overall dimension and shape, for example, for quality control purposes. The scanned physical parameters of each tie plate 103 are communicated to an electronic controller (not shown) which is integrated with or generally associated with the machine 100, before each tie plate is delivered to a plate sorting and orientation portion 129.

The plate sorting and orientation portion 129 includes actuators 131 that can appropriately orient the tie plates 103 for delivery to one of two tie plate depositors 133 of the machine 100. The tie plate depositors 133 may include a magazine or collector that can receive properly-oriented tie plates 103 for placement under the rails 111 by any known device, for example, the actuator arms and associated structure disclosed in the '455 patent. The actuators 131 may operate in response to commands from the electronic controller that is in communication with the sensors 127, such that each tie plate 103 may be uniquely manipulated to achieve a desired orientation before entering into each tie plate depositor 133. The actuators 131 may perform additional functions, such as distributing tie plates 103 to the right or left side of the machine 100, as required, reject plates found to be defective, and so forth. As illustrated, the machine 100 may further include other portions, for example, a track lifting structure 135 for lifting the rails 111 away from the ties 107 during insertion of tie plates 103, an operator cabin 137, an engine, and others.

In the description that follows, like or similar features or elements are denoted by the same reference numerals for simplicity. One embodiment of a tie plate collector 115 is shown in the side-perspective view of FIG. 2 and from a side view in FIG. 3. The tie plate collector 115 is an arrangement of components and systems working together to collect metallic objects from a rail bed as well as sort tie plates from other metallic objects that may be picked up, for example, rail spikes.

The collector 115 includes an endless conveyor 202 circulating between a first or pickup drum 204 and a top drum 206. In the illustrated embodiment of FIGS. 2 and 3, the pickup drum 204 can be selectively magnetized by activation of an electro-magnet disposed therewithin (not shown) or, alternatively, include permanent magnets (not shown) that are symmetrically mounted along the entire inner periphery of the rim of the pickup drum 204, thus creating a magnetic field around the pickup drum 204 that attracts ferrous objects towards the endless conveyor 202. As used herein, magnetic field is defined as a field whose magnetic intensity is strong enough to cause a magnetic force tending to displace metal objects, such as tie plates or rail spikes, that come within the field. The pickup drum 204 is rotatably connected to a machine, for example, the machine 100 (FIG. 1) and disposed to rotate about an axle 208 by way of a motor (not shown). The motor may be any type of suitable rotary actuator that, when active, can selectively rotate the pickup drum 204 at a desired or predetermined rate of rotation. As best shown in FIG. 3, the pickup drum 204 is disposed at an appropriate distance relative to the machine 100 (shown in phantom line) such that its rim portion 210 is placed adjacent to tie plates 103 strewn along the rail bed 105. In the illustrated embodiment, the height of the pickup drum 204 relative to the machine 100 and to the rail bed 105 is adjustable.

During operation, the machine 100 moves along the rails 111 and passes over tie plates 103 lying on the rail bed 105. The pickup drum 204 rotates in the direction of travel of the machine 100, which in FIG. 3 is denoted by arrows, thus passing over the tie plates 103 lying on the ground and, having its magnetic properties activated or present, causes the same as well as other ferrous objects to adhere to it. In other words, an effective range of the magnetic properties of the pickup drum 204 extends into the rail bed 105 such that objects disposed thereon can be attracted by magnetic forces to the pickup drum 204.

Continued rotation of the pickup drum 204 causes the tie plates 103 and other metallic objects, for example, rail spikes 212, to be carried along an ascending portion 214 of the endless conveyor 202. While on the ascending portion 214, the various metallic objects collected are no longer subject to magnetic forces from the pickup drum 204 and are physically retained on the conveyor 202 by gravity. In the illustrated embodiment, the endless conveyor 202 may be made of rubber or a similar material and does not possess magnetic properties. A plurality of evenly-spaced cleats 216 are arranged along the endless conveyor 202 to aid the various objects collected in their path along the ascending portion 214. In alternate embodiments, the endless conveyor 202 may be made of a material having magnetic properties.

Tie plates 103 travelling along the ascending portion 214 of the endless conveyor 202 reach the top drum 206. From there, continued motion of the endless conveyor 202 causes the tie plates 103 to fall onto the transverse conveyor 119 and to be carried to different portions of the machine 100 for additional sorting and orientation. As can be seen in FIG. 3, the top drum 206 is disposed to rotate relative to the machine 100 about a rotation axis 216 that is located higher on the machine 100 than the axle 208 of the pickup drum 204 as well as being longitudinally offset therefrom relative to the machine 100 in the direction of travel. In this arrangement, an imaginary plane 218 intersecting the rotational axes of both the pickup and top drums 204 and 206 is disposed at an angle, θ, relative to the horizontal. The magnitude of the angle θ, as well as the diameters of the pickup and top drums 204 and 206, determines the slope of the ascending portion 214. In the illustrated embodiment, the slope of the ascending portion 214 is about 35 degrees, but other angles may be used.

The collector 115 is well suited for automatically separating tie plates collected from the rail bed 105 from other metallic debris, such as spikes 212, which may be collected from the pickup drum 204. In the illustrated embodiment, the collector 115 includes a separation drum 220 having a magnetized rim 222 disposed around its periphery. In alternate embodiments, a magnetic field around the separation drum 220 may be created by other means, such as by activation of an electromagnet, by permanent magnetization of a metal structure, and others. The separation drum 220 provides a magnetic force whose effective range envelops a segment of the conveyor 202 but that does not substantially overlap with the effective range of the magnetic force generated by the pickup drum 204. The separation drum 220 is disposed above the ascending portion 214 of the endless conveyor 202 at a distance permitting the magnetized rim 222 to collect metallic objects found on the conveyor 202 while permitting tie plates 103 to remain on the conveyor 202 and, further, not interfering with motion of the conveyor 202. In the illustrated embodiment, the position of the separation drum 220 is adjustable to accommodate different types of plates to be collected and sorted.

Figure 2:
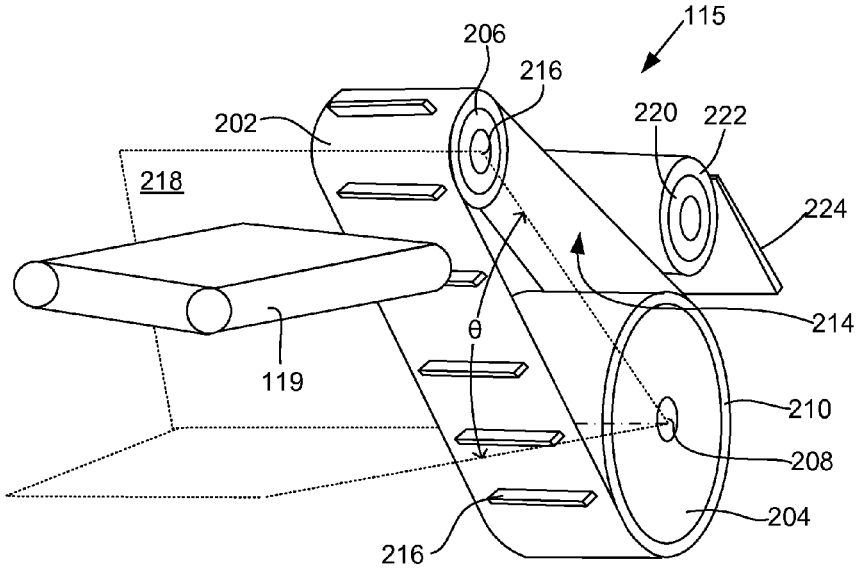
FIG. 2 is a partial outline view in perspective of a tie plate collector and sorter in accordance with the disclosure.
Figure 3:
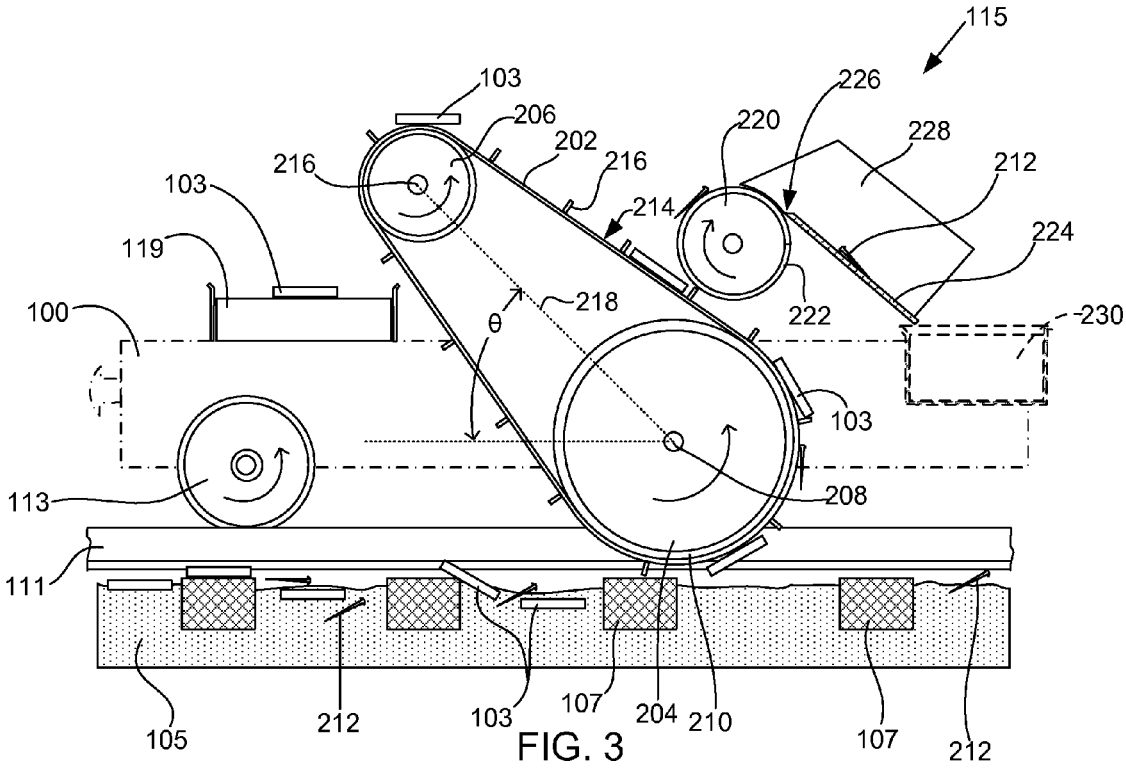
FIG. 3 is a partial side view of a tie plate collector and sorter in accordance with the disclosure.

In the embodiment shown in FIG. 2, the separation drum 220 is associated with a separation slide 224 that forms a wedge 226 at an end thereof. During rotation of the separation drum 220, objects attached to the magnetized rim 222 are carried off the endless conveyor 202 and are detached from the separation drum 220 by the wedge 226 before sliding down the separation slide 224 between two optional sidewalls 228 (only one shown in FIG. 3).

In one embodiment, the magnetized rim 222 on the separation drum 220 may be formed by a flexible sheet of permanently magnetized material wrapped and secured around the outer peripheral surface of the drum 220. The magnitude of magnetic forces attracting objects to the separation drum 220 can be selected to be strong enough to cause metallic debris, such as spikes 212, to adhere to the magnetized rim 222 and be carried off the endless conveyor 202, but weak enough to leave heavier objects, such as tie plates 103, to continue travelling along on the conveyor. In this fashion, the collector 115 may advantageously separate or sort tie plates 103 collected from the rail bed 105 from other debris, such as spikes 212 or other ferrous objects.

Unwanted material collected by the separation drum 220 can be discarded onto the shoulder of the track or collected for later disposal or recycling. In the embodiment shown in FIG. 3, an optional catch basin 230 is shown disposed at the outlet of the separation slide 224. The optional catch basin 230 may collect unwanted ferrous objects or, in the absence of the basin, such unwanted material may simply be dropped back to the ground.

Figure 4:
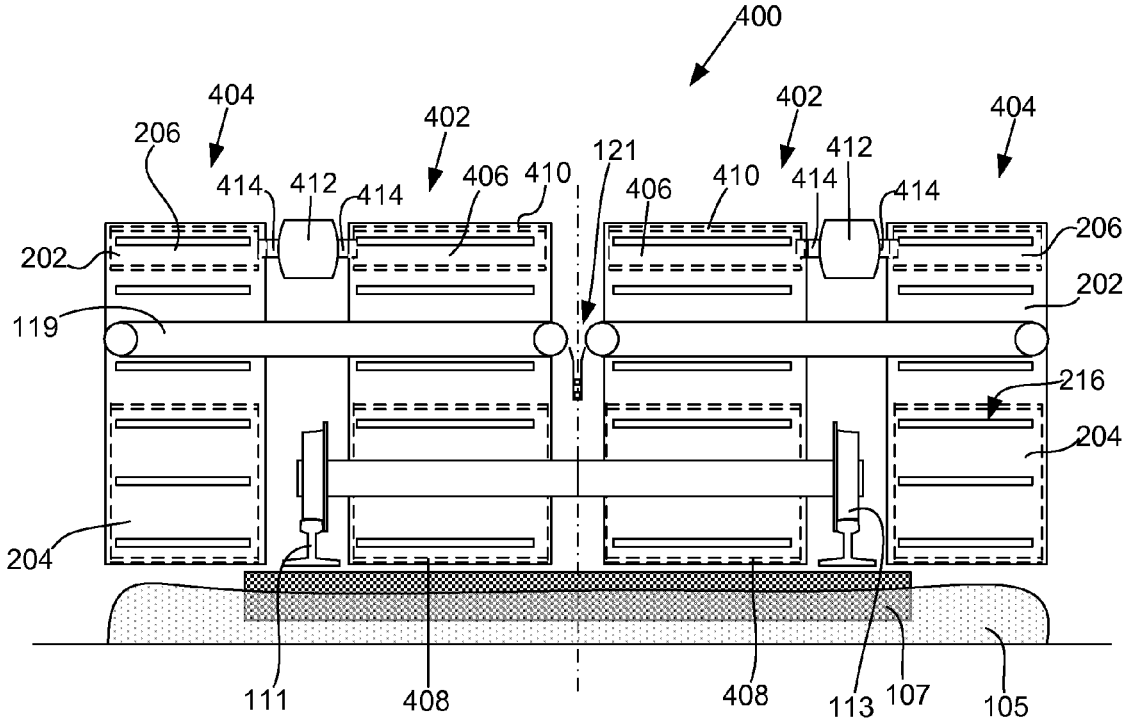
FIG. 4 is a front view of an alternate embodiment of a tie plate collector arrangement in accordance with the disclosure.

A partial front view of an alternate embodiment for a machine 400, with portions thereof removed for clarity, is shown in FIG. 4. In this embodiment, multiple collectors are used to collect ferrous material and tie plates from the rail bed. As in previous figures, like or similar elements are denoted with the same reference numerals as previously used for simplicity. More particularly, and as can be best seen in FIG. 4, the machine 400 travels along the rails 111 on wheels 113. As shown, the machine 400 includes two inboard collectors 402 and two outboard collectors 404. Each of the outboard collectors 404 may be the same or similar to the collector 115 described and shown relative to FIGS. 2 and 3. Thus, each outboard collector 404 includes an endless conveyor 202 operating between a pickup drum 204 and a top drum 206. The separation drums 220 (not shown, see FIG. 3) are not visible in this view but are disposed behind each of the two outboard collectors 404.

Unlike the two outboard collectors 404, which are disposed on the field side of the rails 111, each of the inboard collectors 402 (or a single inboard collector) is disposed on the gage side or between the rails 111. The inboard collector 402 may be substantially similar in structure and operation as the outboard collectors 404 or the collector 115 described and shown relative to FIGS. 2 and 3, differing only, if applicable, in the overall size or width of their respective endless conveyor belts 406. Accordingly, each inboard collector 402 includes a pickup drum 408, a top drum 410, and a separation drum (not shown). During operation of the machine 400, the inboard and outboard collectors 402 and 404 can efficiently sweep a substantial portion of the rail bed 105 to collect tie plates lying thereon, as well as optionally remove any other ferrous objects found there for later disposal or recycling. In the illustrated embodiment, motors 412 are associated with the top drums 206 and 410 via axles 414 to drive the endless conveyors 202 and 406.

Industrial Applicability

The disclosure further provides a method for automatically sorting tie plates collected from the field during construction, repair, or maintenance of railroad tracks. The automation of the tie plate sorting process presents a considerable advancement of the current state of the art, which relies on manual sorting and operations. The current manual operations are time consuming, prone to operator error, and further place workers close to large equipment having numerous moving parts. Notwithstanding any such issues, use of the known manual operations in this labor intensive operation also increases the operating cost of the machine. All methods described herein can be performed in any suitable order unless otherwise indicated herein or otherwise clearly contradicted by context.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A machine for collecting tie plates strewn along a rail bed, comprising:

a frame adapted for travel along a railroad in a forward direction;

a pickup drum rotatably supported by the frame and extending over a portion of the rail bed, the pickup drum having magnetic properties such that ferrous objects that include tie plates and other objects strewn along the rail bed portion are attracted toward the pickup drum;

a top drum rotatably supported by the frame and disposed at a location that is higher and forward of the pickup drum, wherein the top drum is arranged to rotate about an axis that is parallel to an axis of rotation of the pickup drum;

an endless conveyor arranged to circulate around the pickup and top drums;

a separation drum disposed between the pickup drum and the top drum along an ascending portion of the endless conveyor, wherein the separation drum is arranged to generate a magnetic force that is strong enough to attract the other objects but not the tie plates disposed on the ascending portion, thus separating the tie plates from the other objects.

2. The machine of claim 1, further comprising a separation slide having a wedge disposed adjacent the magnetized rim of the separation drum such that objects attached thereto are separated from the separation drum and are provided to the separation slide.

3. The machine of claim 1, further comprising a plurality of cleats disposed along the endless conveyor.

4. The machine of claim 1, wherein the pickup drum includes a plurality of permanent magnets symmetrically disposed internally along an entire periphery of a rim portion of the pickup drum to provide the magnetic force.

5. The machine of claim 1, wherein the pickup drum is arranged to attract and lift objects from the bed of the railroad that are heavier than objects adapted to be lifted from the endless conveyor by the separation drum.

6. The machine of claim 1, wherein the separation drum is disposed at a distance relative to the ascending portion of the endless conveyor, wherein the distance is large enough to provide access of tie plates under the separation drum and small enough to permit attachment of ferrous objects other than tie plates to the separation drum.

7. The machine of claim 1, wherein, during operation, the machine is adapted to collect tie plates from the rail bed by attachment of the same onto the pickup drum, transfer of the tie plates onto the endless conveyor, sorting of tie plates from other ferrous objects collected from the rail bed by attachment of the other ferrous objects to the separation drum, and delivery of the tie plates off the endless conveyor and onto a conveyor system of the machine.

8. The machine of claim 1, wherein the magnetized rim of the separation drum includes a sheet of magnetic material that is wrapped around the entire periphery of the separation drum.

9. The machine of claim 1, wherein the endless conveyor is made of a non-magnetic material.

10. A conveyor system for sorting ferrous tie plates used in railroads from other ferrous objects collected from a rail bed, the conveyor system comprising:

a pickup drum rotatably supported by a frame and extending over the rail bed, the pickup drum generating a magnetic force such that the tie plates and the other ferrous objects strewn along the rail bed are attracted toward the pickup drum;

a top drum rotatably supported by the frame and disposed at a location that is higher and offset from the pickup drum, wherein the top drum is arranged to rotate about an axis that is parallel to an axis of rotation of the pickup drum;

an endless conveyor arranged to circulate around the pickup and top drums;

a separation drum disposed between the pickup drum and the top drum along an ascending portion of the endless conveyor, wherein the separation drum is arranged to generate a magnetic force that is strong enough to attract the other objects but not the tie plates disposed on the ascending portion, thus separating the tie plates from the other objects.

11. The conveyor system of claim 10, further comprising a separation slide having a wedge disposed adjacent a magnetized rim of the separation drum such that objects attached thereto are separated from the separation drum and are provided to the separation slide.

12. The conveyor system of claim 10, wherein a diameter of the pickup drum is larger than a diameter of the top drum.

13. The conveyor system of claim 10, wherein the pickup drum is adapted to attract and lift objects from the rail bed that are heavier than objects adapted to be lifted from the endless conveyor by the separation drum.

14. The conveyor system of claim 10, wherein a plane defined by the axes of rotation of the pickup drum and the top drum is disposed at an angle relative to a horizontal plane.

15. The conveyor system of claim 10, wherein the separation drum is disposed at a distance relative to the ascending portion of the endless conveyor, wherein the distance is large enough to provide access of tie plates under the separation drum and small enough to permit attachment of ferrous objects other than tie plates to the separation drum.

16. The conveyor system of claim 10, wherein during operation, the conveyor system is adapted to collect tie plates from the rail bed by attachment of the same onto the pickup drum, transfer of the tie plates onto the endless conveyor, sorting of tie plates from other ferrous objects collected by attachment of the other ferrous objects to the separation drum, and delivery of the tie plates off the endless conveyor at the top drum.

17. The conveyor system of claim 10, wherein a rim of the separation drum includes a sheet of magnetic material that is wrapped around the entire periphery of the separation drum.

18. The conveyor system of claim 10, wherein objects disposed on the endless conveyor are adapted to be beyond an effective range of the magnetic force of the pickup drum and within an effective range of the magnetic force of the separation drum.

19. A method of sorting ferrous tie plates collected from a rail bed from other ferrous objects collected from the rail bed, the method comprising:

rotatably supporting a pickup drum from a frame, and extending the pickup drum over the rail bed;

attracting the tie plates and the other ferrous objects strewn along the rail bed toward the pickup drum by magnetic force;

rotatably supporting a top drum from the frame and positioning the top drum at a location that is higher and offset relative to the pickup drum, wherein the top drum is arranged to rotate about an axis that is parallel to an axis of rotation of the pickup drum;

circulating an endless conveyor around the pickup and top drums;

rotatably supporting a separation drum between the pickup drum and the top drum along an ascending portion of the endless conveyor;

removing the other ferrous objects but not the tie plates from the endless conveyor by attracting the other ferrous objects to the separation drum by magnetic forces; and providing a separation slide having a wedge disposed adjacent the magnetized rim of the separation drum such that other ferrous objects attached thereto are separated from the separation drum and are provided to the separation slide.

20. The method of sorting tie plates of claim 19, further including attaching the frame to a machine adapted to roll along a railroad track.

* * * * *